US011386750B2

(12) United States Patent
Lyons et al.

(10) Patent No.: US 11,386,750 B2
(45) **Date of Patent: *Jul. 12, 2022**

(54) LINKED COMMUNICATIONS FOR GAMING SYSTEMS USING ACOUSTIC SIGNATURES

(71) Applicant: SG Gaming, Inc., Las Vegas, NV (US)

(72) Inventors: Martin Lyons, Henderson, NV (US); Ronald Gray, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/224,595

(22) Filed: Apr. 7, 2021

(65) Prior Publication Data

US 2021/0225124 A1 Jul. 22, 2021

Related U.S. Application Data

(63) Continuation of application No. 16/682,274, filed on Nov. 13, 2019, now Pat. No. 10,997,821, which is a continuation of application No. 16/140,932, filed on Sep. 25, 2018, now Pat. No. 10,510,207.

(60) Provisional application No. 62/563,759, filed on Sep. 27, 2017.

(51) Int. Cl.
*G07F 17/32* (2006.01)

(52) U.S. Cl.
CPC ..... *G07F 17/3241* (2013.01)

(58) Field of Classification Search
USPC ..... 463/43
See application file for complete search history.

(56) References Cited

U.S. PATENT DOCUMENTS

| | | | | |
|---|---|---|---|---|
| 8,262,457 | B2 | 9/2012 | Ansari et al. | |
| 8,305,423 | B2 | 11/2012 | Fabregat et al. | |
| 8,678,923 | B2 | 3/2014 | Radek et al. | |
| 9,094,453 | B2 | 7/2015 | Ady et al. | |
| 9,858,751 | B2 | 1/2018 | Bytnar et al. | |
| 2006/0148562 | A1* | 7/2006 | Walker | G07F 17/32 463/30 |
| 2006/0252551 | A1* | 11/2006 | Walker | G07F 17/3244 463/43 |
| 2010/0184509 | A1 | 7/2010 | Sylla et al. | |
| 2010/0240435 | A1* | 9/2010 | Gagner | G07F 17/32 463/20 |
| 2010/0298049 | A1 | 11/2010 | Ansari et al. | |

(Continued)

*Primary Examiner* — Pierre E Elisca

(57) ABSTRACT

A gaming system includes logic circuitry and a gaming machine for conducting a casino wagering game. The logic circuitry receives, via an acoustic input component of the gaming machine, an acoustic capture signal representative of a player account identifier corresponding to a player account from a mobile device, determines the player account identifier represented by the capture signal, and associates a gaming session on the gaming machine with the corresponding player account. In addition, the logic circuitry, in response to receiving in a prescribed manner, via the acoustic input component, an acoustic maintain-session signal from the mobile device, maintains the association between the gaming session on the gaming machine and the corresponding player account for a period of time, in response to failing to receive the maintain-session signal in the prescribed manner, the logic circuitry terminates the association between the gaming session and the corresponding player account.

25 Claims, 10 Drawing Sheets

(56) References Cited

U.S. PATENT DOCUMENTS

| | | | | |
|---|---|---|---|---|
| 2014/0045579 | A1* | 2/2014 | Filipour | G07F 17/3244 463/25 |
| 2014/0073422 | A1 | 3/2014 | Sylla et al. | |
| 2016/0019746 | A1 | 1/2016 | Lyons et al. | |
| 2016/0071373 | A1 | 3/2016 | Anderson et al. | |
| 2016/0196721 | A1* | 7/2016 | Filipour | G07F 17/3267 463/25 |
| 2017/0169650 | A1* | 6/2017 | Powell | G07F 17/3248 |
| 2018/0033240 | A1* | 2/2018 | Mahasuverachai | G07F 17/323 |
| 2018/0122178 | A1* | 5/2018 | Montgomery | G07F 17/3244 |
| 2018/0158285 | A1* | 6/2018 | Mahasuverachai | G07F 17/3288 |

* cited by examiner

LINKED COMMUNICATIONS FOR GAMING SYSTEMS USING ACOUSTIC SIGNATURES

RELATED APPLICATION

This patent application is a continuation of U.S. patent application Ser. No. 16/682,274, filed Nov. 13, 2019, which is a continuation of U.S. patent application Ser. No. 16/140,932 filed Sep. 25, 2018 (issued as U.S. Pat. No. 10,510,207), which claims the priority benefit of U.S. Provisional Patent Application No. 62/563,759 filed Sep. 27, 2017, the contents of each application are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2021 SG Gaming, Inc.

FIELD OF THE INVENTION

The present invention relates generally to gaming systems, apparatus, and methods and, more particularly, to gaming systems using acoustic signals for establishing and/or maintaining communications with mobile user devices.

BACKGROUND OF THE INVENTION

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new features and/or functionality that will attract frequent play.

At least some manufacturers may provide at least some features to a player using mobile user devices (also sometimes referred to herein as "mobile devices") carried or worn by the player, such as smartphones and wearable electronics. For example, the player may provide credentials to a web or application interface to access player tracking features, bonus games, and the like. To match a player to a particular wagering game machine, the player may be required to manually pair the mobile user device with the wagering game machine. That is, the player provides user input via the mobile user device that identifies the wager game machine such that, during a gaming session, data associated with the player is transmitted to the game machine and/or data associated with the game machine is transmitted to the mobile user device. However, the pairing process may be cumbersome, time-consuming, and/or confusing to a player (e.g., the player or mobile user device is unable to properly identify the correct wagering game machine to pair with), which may lead to the player abandoning play of the game. Moreover, some communication methods used to establish communication between two computing devices may require particular components or modules to be installed at the wagering game machines that may be costly to add to new or existing game machines.

SUMMARY OF THE INVENTION

According to one aspect of the present invention, a gaming system comprises logic circuitry and a gaming machine for conducting a casino wagering game. The logic circuitry receives, via an acoustic input component of the gaming machine, an acoustic capture signal representative of a player account identifier corresponding to a player account and having distinctive capture characteristics from a mobile device, determines the player account identifier represented by the capture signal, and associates a gaming session on the gaming machine with the corresponding player account. In addition, the logic circuitry, in response to receiving in a prescribed manner, via the acoustic input component, an acoustic maintain-session signal having distinctive maintain-session characteristics from the mobile device, maintains the association between the gaming session on the gaming machine and the corresponding player account for a period of time. In response to failing to receive the maintain-session signal in the prescribed manner, the logic circuitry terminates the association between the gaming session on the gaming machine and the corresponding player account. The gaming system may be incorporated into a single, freestanding gaming machine.

According to another aspect of the invention, a method of operating a gaming system is provided. The gaming system includes logic circuitry and a gaming machine with an acoustic input component. The method is at least partially performed by the logic circuitry. The method includes receiving, via the acoustic input component, an acoustic capture signal including a player account identifier corresponding to a player account and having distinctive capture characteristics from a mobile device, reading the player account identifier contained within the capture signal, associating a gaming session on the gaming machine with the corresponding player account, and transmitting, to the corresponding player account, game-play information related to the gaming session on the gaming machine.

According to another aspect of the invention, a method of operating a gaming system is provided. The gaming system includes logic circuitry and a gaming machine having an acoustic input component. The method is at least partially performed by the logic circuitry. The method includes initiating a gaming session associated with a player account on the gaming machine, and in response to receiving in a prescribed manner, via the acoustic input component, a maintain-session signal having distinctive maintain-session characteristics from a mobile device, maintaining the association between the gaming session on the gaming machine and the player account for a period of time. The method further includes terminating, in response to failing to receive the maintain-session signal in the prescribed manner, the association between the gaming session on the gaming machine and the player account.

Additional aspects of the invention will be apparent to those of ordinary skill in the art in view of the detailed description of various embodiments, which is made with reference to the drawings, a brief description of which is provided below.

Figure 1:
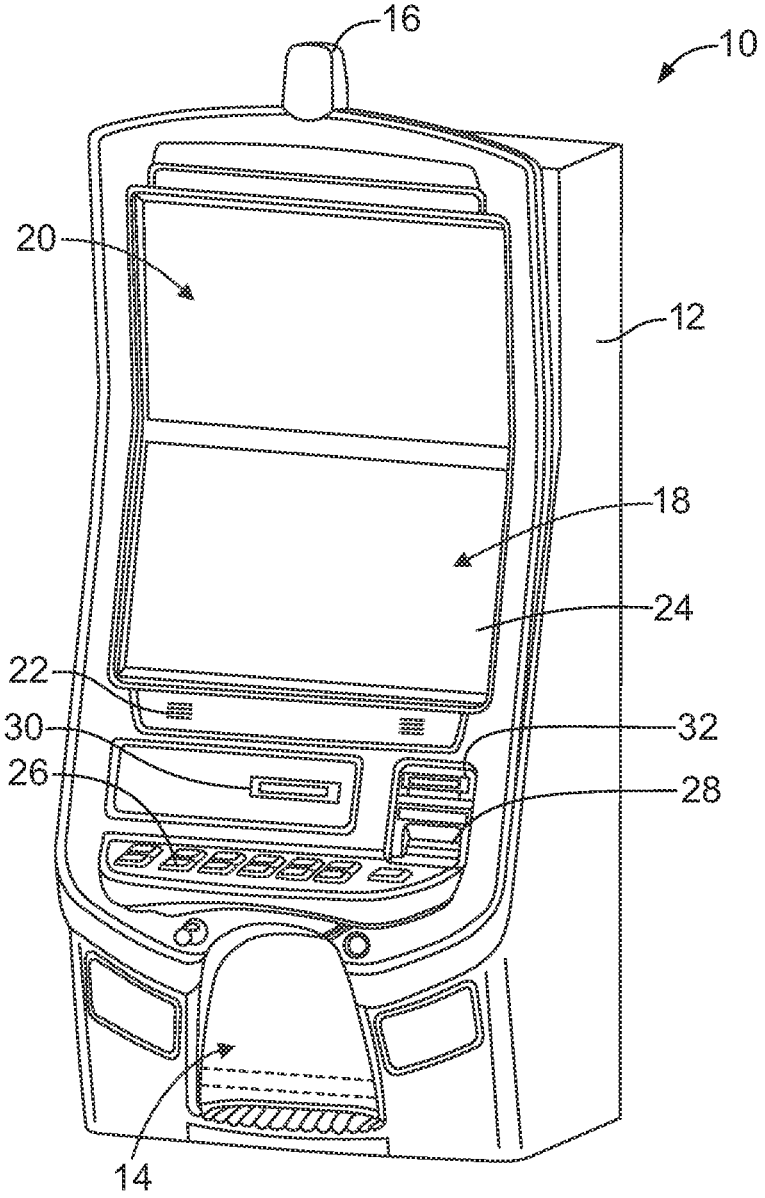
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

As used herein, "audio" and "acoustic" refer to audible and inaudible (e.g., ultrasonic and infrasonic) tones and sound waves. "Audio signals" and "acoustic signals" are used interchangeably to refer to tones and sound waves generated electronically (i.e., by a computing device). Audio and acoustic signals as used herein not only refer to the electronic or digital form of the signals, but also the tones and sound waves emitted when the audio signals are provided to an acoustic output component (e.g., a speaker).

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing, models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset, jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter. The physical item may, for example, be currency bills, coins, tickets, vouchers, coupons, cards, and/or computer-readable storage mediums. The deposited cash or credits are used to fund wagers placed on the wagering game played via the gaming machine 10. That is, wagers decrease or draw upon the credit balance. Conversely, awards from play of a wagering game may increase the credit balance. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter, the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
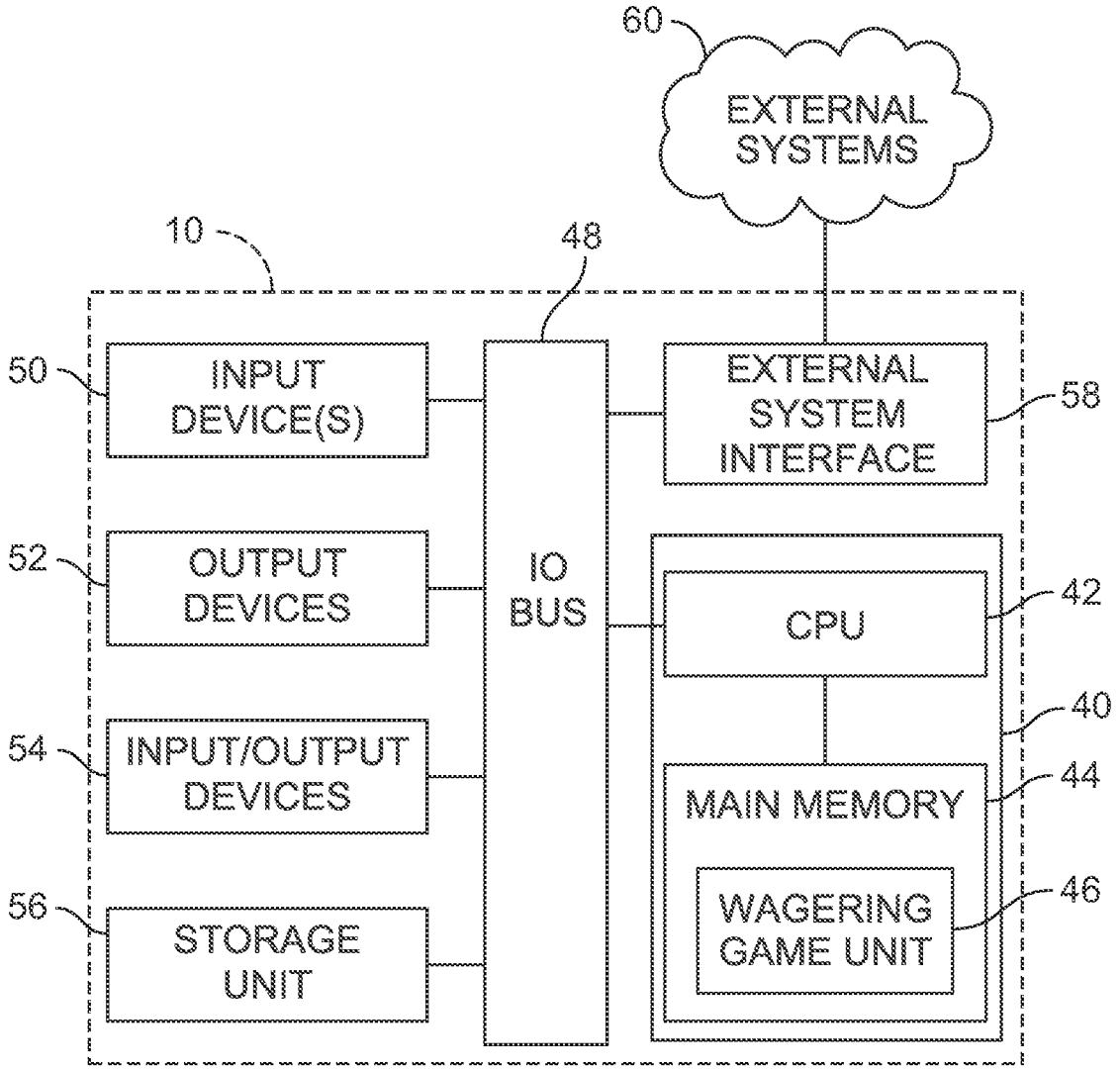
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. For example, the game-logic circuitry 40 operates to execute a wagering-game program causing the primary display 18 or the secondary display 20 to display the wagering game. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 3:
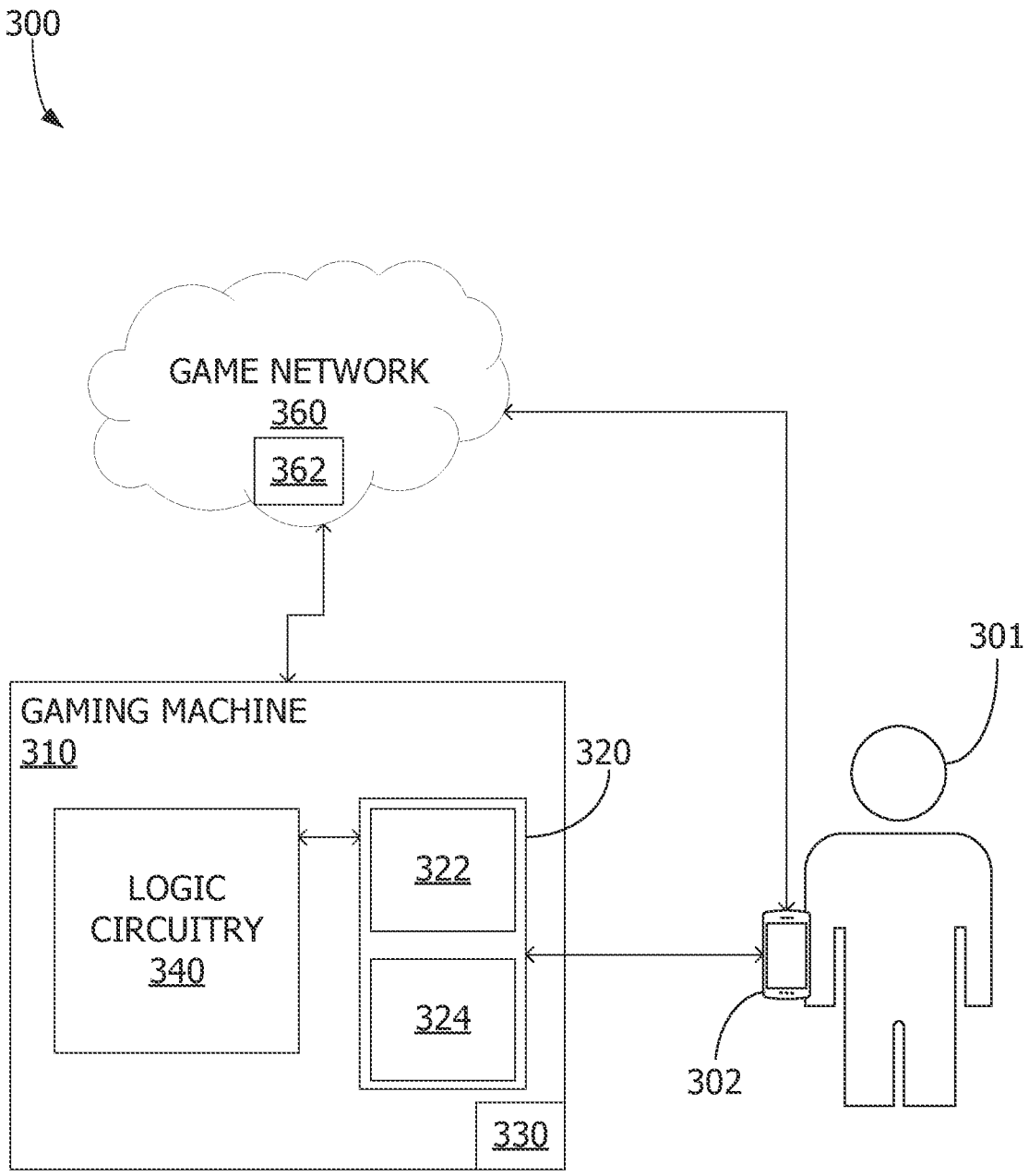
FIG. 3 is a schematic view of an example gaming system that includes an acoustic interface for establishing and maintain communication with mobile user devices according to an embodiment of the present invention.

FIG. 3 is a schematic diagram of an example gaming system 300 including a gaming machine 310 and an external game network 360. The gaming machine 310 and game network 360 may be substantially similar to the gaming machine 10 and external system 60 (both shown in FIG. 1), respectively, and absent contrary representation, include similar components and/or functionality. In other embodiments, the gaming system 300 includes additional, fewer, or alternative devices, including those described elsewhere herein.

In the example embodiment, the gaming machine 310 includes an acoustic interface 320, a presence sensor 330, and logic circuitry 340, and the game network 360 includes network logic circuitry 362. The network logic circuitry 362 may be similar to the logic circuitry 340, and thus may perform one or more of the features and tasks performed by the logic circuitry 340 as described herein. The gaming machine 310 is communicatively coupled to the game network 360. At least one of the gaming machine 310 or the game network 360 is communicatively coupled to a mobile device 302. The mobile device 302 is a portable computing device (e.g., a laptop, tablet, a smartphone, a smart watch, a wearable electronic, etc.) associated with a player 301. Communicatively coupling the mobile device 302 to the gaming machine 310 and/or the game network 360 may facilitate integration of the mobile device 302 with game play and/or other features provided by the gaming system 300.

In at least some embodiments, a software application associated with the system 300 is stored on the mobile device 302 to provide the player 301 with features associated with the system 300. For example, the mobile device 302 may display information from system 300 through the application. In another example, a digital wallet that securely stores financial payment information on mobile device 302 may be used to purchase additional credits, order products (e.g., food and drinks) and/or services, and the like through the application. In other embodiments, the mobile device 302 accesses a web interface to provide the features described herein. In addition to the new features provided by integration of the mobile device 302 with the system 300, the system 300 may harness the processing, memory, and/or network capabilities of the mobile device 302 to perform various tasks, thereby reducing the computing resource burden on the system 300.

In the example embodiment, the system 300 communicates with the mobile device 302 to authenticate or verify the identity of the player 301, the mobile device 302, and/or a player account of the player 301 for player tracking. The player account may be stored by game network 360. The player account may include, for example, game play data (e.g., scores, game play progress, etc.), credit balance data, and other data associated with the player 301, including data unrelated to game play. For example, the player account may include a list of historical purchases made by the player 301, such as drink purchases, and/or timestamps associated with different events involving the player 301 (e.g., the last time the player 301 visited the casino). When the system 300 verifies the identity of the player 301, the mobile device 302, and/or the player account, data from the player account is provided to the gaming machine 310 for a gaming session as described herein. Additionally or alternatively, the mobile device 302 may be used to verify the presence of the player 301 at the gaming machine 310 during the gaming session to facilitate improved accuracy and speed detecting abandoned gaming sessions and absent players. Detecting abandoned gaming sessions at the machine 310 may enable the gaming machine 310 to end the abandoned gaming session automatically and become available for a new gaming session with a new player.

The acoustic interface 320 is configured to facilitate establishing and/or maintaining a gaming session. In particular, the acoustic interface 320 operates in conjunction with a corresponding acoustic interface of the mobile device 302 to transmit and/or receive acoustic signals. The acoustic signals are configured to transmit data between the gaming machine 310 and the mobile device 302. That is, the acoustic signals have distinctive characteristics that are encoded with data. When signal analysis is performed on the acoustic signals, the encoded data may be extracted or otherwise determined. In one example, the acoustic signals are modulated to form a bit stream. The receiver of the modulated acoustic signal demodulates the signal to collect the bit stream.

Unlike other forms of communication between computing devices, such as near field communication (NFC), Bluetooth, Wi-Fi, cellular communication, and the like, acoustic interfaces, such as the interface 320, are adopted by a majority (if not all) mobile devices. The prevalence of acoustic interfaces reduces the barrier of entry for players to use this feature. In addition, in at least some embodiments, the gaming machine 310 may include one or more metal components that may attenuate radio signals, impact triangulation of signals to the correct gaming machine 310, or otherwise negatively impact communication with the gaming machine 310 using digital communication rather than acoustic communication. Moreover, adding acoustic interfaces to a gaming machine or mobile device may be a relatively inexpensive process unlike the components of at least some of the aforementioned forms of communication. In at least some embodiments, the features described herein may be relatively quick to use and are at least partially automated to reduce the burden on the player 301 (i.e., the features are "tap-and-go" features).

In the example embodiment, the acoustic interface 320 is integrated with the gaming machine 310. In other embodiments, the acoustic interface 320 may be at least partially located remotely from the gaming machine 310. In such embodiments, the acoustic interface 320 is communicatively coupled to the logic circuitry 340. As shown in FIG. 3, the acoustic interface 320 includes an acoustic input component 322 and an acoustic output component 324. In at least some embodiments, acoustic interface 320 includes additional, fewer, or alternative components, including those described elsewhere herein. For example, the acoustic interface 320 may include only one of the input component 322 or the output component 324. In another example, the acoustic interface 320 includes a plurality of input components 322 and/or output components 324. In yet another example, the acoustic interface 320 includes a device interface (not shown in FIG. 3) to support mobile devices as described herein. In the example embodiment, the acoustic interface 320 of the gaming machine 310 is configured for at least unidirectional communication with corresponding acoustic components of the mobile device 302. That is, the acoustic interface 320 is configured to receive acoustic signals from the mobile device 302 (e.g., via the acoustic input component 322), and/or is configured to transmit acoustic signals to the mobile device 302 (e.g., via the acoustic output component 324).

The acoustic input component 322 is configured to receive acoustic signals. In some embodiments, the input component 322 may also process the acoustic signals, such as filtering noise from the signal and/or converting the analog acoustic signals to corresponding digital signals. In the example embodiment, the input component 322 is a microphone. The input component 322 may include additional devices and/or circuits to process the received acoustic signals, such as analog to digital converters, filter circuits, and microprocessors. In certain embodiments, processing the acoustic signals may be at least partially performed by the logic circuitry 340.

The acoustic output component 324 is configured to emit acoustic signals. The acoustic signals may include, but are not limited to, game play sounds, notification sounds, and/or acoustic signals embedded with data as described herein. In the example embodiment, the acoustic output component 324 is a speaker or a plurality of speakers. In at least some embodiments, the output component 324 may include other devices and/or circuits to generate and/or emit the acoustic signals, such as digital to analog converters, modulation circuits, and the like. In at least some embodiments, the logic circuitry 340 is configured to transmit the acoustic signal to the output component 324 for emission of the signal.

In the example embodiment, the acoustic interface 320 is configured to be selectively activated and deactivated by logic circuitry 340. That is, the acoustic interface 320 receives and/or emits acoustic signals when activated, and the acoustic interface 320 does not receive and/or emit acoustic signals when deactivated. In some embodiments, the acoustic input component 322 and the acoustic output component 324 are separately activated and deactivated. Selectively activating the acoustic interface 320 enables resources of logic circuitry 340 to be allocated to other tasks and components and limits miscommunication intended for the mobile device 302 as described herein.

The presence sensor 330 is configured to detect the presence of players and/or mobile devices near the gaming machine 310. In particular, in the example embodiment, the presence sensor 330 is configured to detect a mobile device and/or a player to cause the logic circuitry 340 to selectively enable the acoustic interface 320 in response to detecting a nearby mobile device or player. Although the sensor 330 is described herein as a single sensor, it is to be understood that gaming machine 310 may include multiple sensors 330 having different or similar types, configurations, and the like. The presence sensor 330 is coupled to the cabinet of the gaming machine 310 in a suitable configuration to detect the player 301 and/or the mobile device 302. The presence sensor 330 is communicatively coupled to the logic circuitry 340 to notify the logic circuitry 340 of the presence of the player 301 at the gaming machine 310. More specifically, the presence sensor 330 collects sensor data and transmits the sensor data to the logic circuitry 340 for analysis. The presence of the player 301 may be used, for example, to determine if the player 301 is approaching the gaming machine 310 to begin a gaming session and/or to determine if the player 301 has left the gaming machine 310 during an in-progress gaming session.

The presence sensor 330 is configured to detect the player 301 and/or the mobile device 302 within a detection range. The detection range may be, for example, a suitable distance range in which the sensor 330 is configured to collect sensor data, or the detection range may be an effective communication range of the sensor 330. As used herein, a "communication range" refers to a distance defined by the signal characteristics of signals communicated between two devices. Although signal communication may be possible outside of the communication range, the signals may be increasingly susceptible to noise degradation and other factors that cause the communication to become unreliable as the distance between the devices is extended beyond the communication range. In some embodiments, the presence sensor 330 is a proximity sensor for detecting the player 301 or the mobile device 302. For example, the presence sensor 330 may be a time-of-flight laser sensor configured to detect the mobile device 302 approaching the gaming machine 310. In certain embodiments, when the sensor 330 detects the player 301 or the mobile device 302, the logic circuitry 340 or the sensor 330 may classify the movement of the detected object to determine if the player 301 is approaching the gaming machine 310, proximate the gaming machine 310, or passing by the gaming machine 310. The logic circuitry 340 may cause different processes to be performed based on the classified movement.

In some embodiments, the presence sensor 330 may be a communication beacon that communicates with the mobile device 302 to detect the presence of the player 301. For example, the presence sensor 330 may be a Bluetooth, Bluetooth Low Energy (BLE), Wi-Fi, and/or NFC beacon that detects the mobile device 302. In such embodiments, the presence sensor 330 may transmit and/or receive data from the mobile device 302. In certain embodiments, the presence sensor 330 and/or the audio interface 320 may be used to determine the location of players within a casino or other gaming establishment. That is, the presence sensor 330 and/or the audio interface 320 may be configured to determine how far away a player (or mobile device) is from the gaming machine 310. By analyzing the distances determined by multiple gaming machines, an approximate location of the player may be identified.

In the example embodiment, the gaming system 300 is configured to perform three processes for managing a gaming session—(i) establish a gaming session, (ii) maintain a gaming session, and (iii) end a gaming session. In particular, the acoustic interface 320 is configured to communicate with the mobile device 302 to establish the gaming session during a session-establishment process and to maintain the gaming session during a maintain-session process. When communication is interrupted, that association between the player account of the player 301 and the gaming session is terminated, or, in some cases, temporarily suspended. Concurrent to or subsequent to terminating the association between the player account and the gaming session, the gaming session is terminated during an end-session process, thereby freeing the gaming machine 310 for a subsequent gaming session. Moreover, the processes described herein enable pairing or linking the mobile device 302 to the gaming session, thereby providing additional features to the player 301 via the mobile device 302. For example, when the mobile device 302 is paired to the gaming session, player account information may be displayed on the mobile device 302. In another example, a digital wallet stored on the mobile device 302 may be used to purchase credits, products (e.g., drinks), and/or services provided by the game network 360.

The acoustic interface 320 is configured to communicate with the mobile device 302 using acoustic signals embedded with data. The acoustic signals have particular characteristics (e.g., amplitude, phase, frequency, modulation, etc.) that represent digital data. The logic circuitry 340 and/or the mobile device 302 may be configured to perform signal analysis on the acoustic signals to extract the data. The acoustic interface 320 and/or the mobile device 302 may include circuitry and/or devices configured to facilitate embedding and extracting the data from the acoustic signals. Although the example embodiment describes the acoustic input component 322 receiving acoustic signals from an acoustic output component (e.g., speaker) of the mobile device 302, it is to be understood that the acoustic output component 324 may be used to generate and emit the acoustic signals to be received by an acoustic input component (e.g., microphone) of the mobile device 302 in addition to or alternative to the input component 322 receiving acoustic signals. That is, the acoustic data transmission described herein may be unidirectional or bidirectional.

Figure 4:
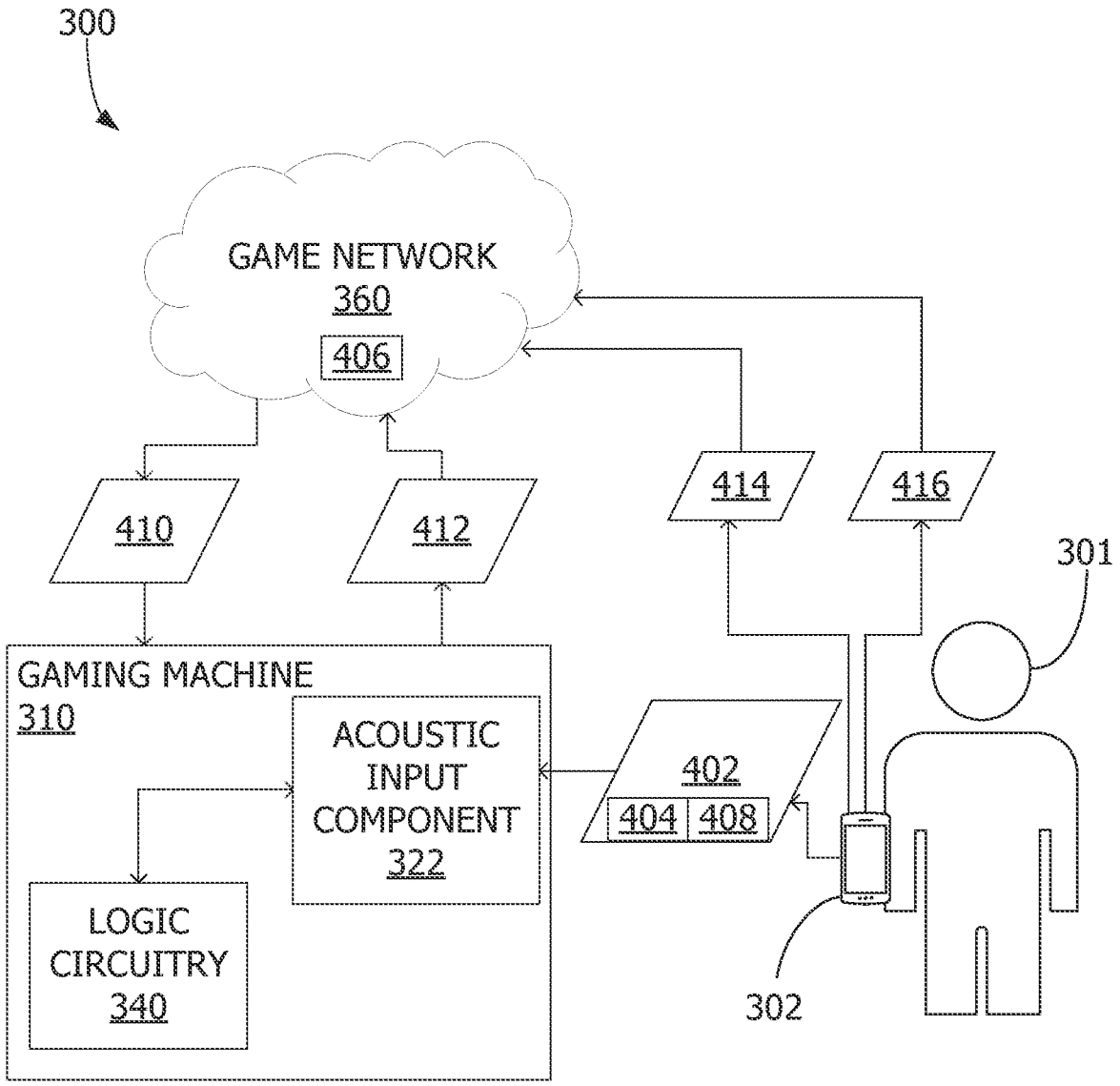
FIG. 4 is a data flow diagram of a session-establishment process performed by the example gaming system shown in FIG. 3.
Figure 5:
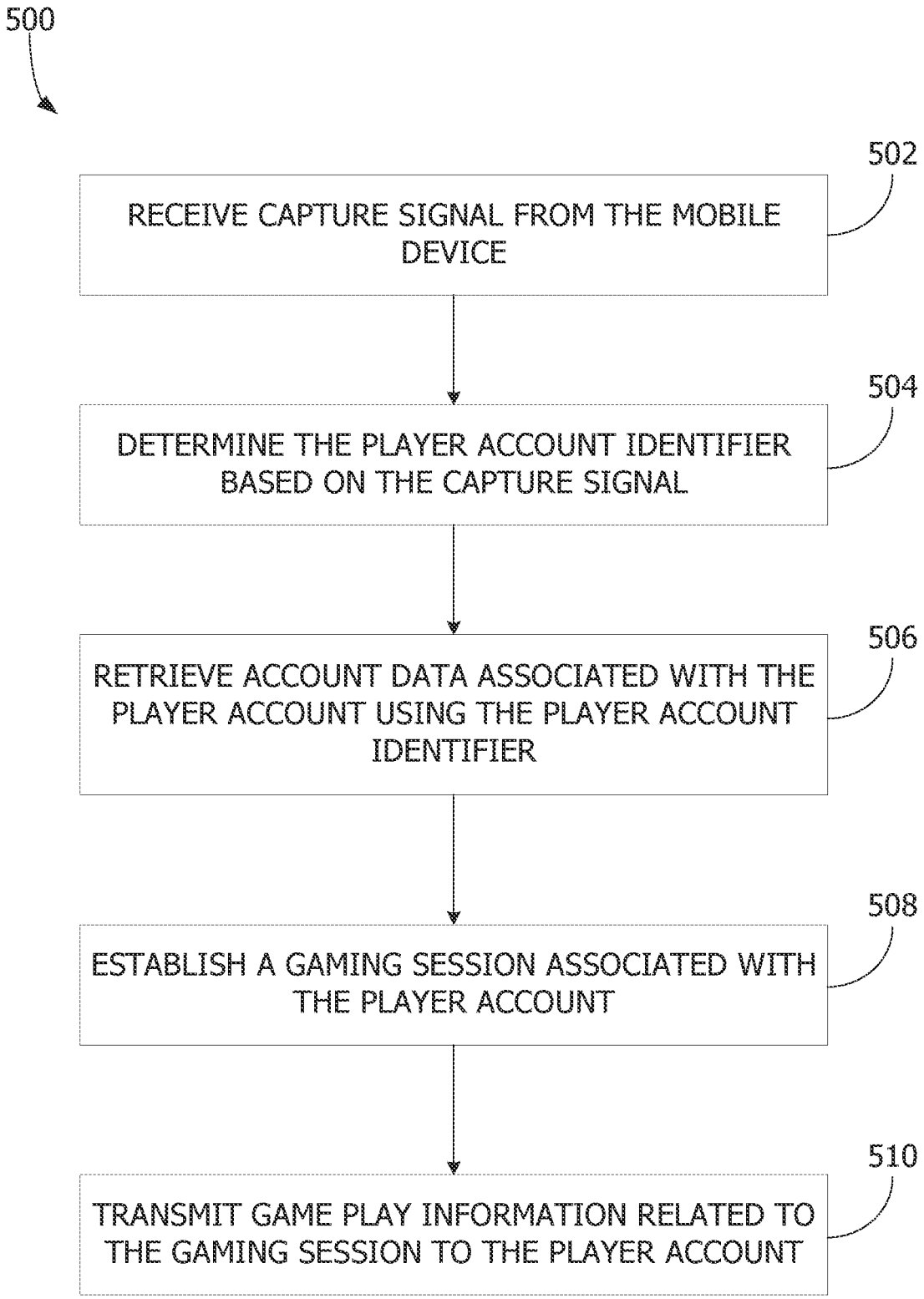
FIG. 5 is a flowchart of an example session-establishment process in accord with at least some aspects of the disclosed concepts.

FIG. 4 is a data flow diagram of an example session-establishment process performed by the gaming system 300 shown in FIG. 3. FIG. 5 is a flow diagram of the session-establishment process 500 shown in FIG. 4. In other embodiments, the process 500 may include additional, fewer, or alternative data elements and/or steps, including those described elsewhere herein.

In the example embodiment, the player 301 activates the application installed on his or her mobile device 302 (or accesses a web interface associated with the system 300) when the player 301 wants to begin a gaming session on gaming machine 310. Among other options presented to the player 301, the application provides the player an option to initiate the process 500. In particular, when the player 301 selects the option to initiate the process 500, the mobile device 302 is configured to emit a capture signal 402. The capture signal 402 is an acoustic signal having specific characteristics (e.g., frequency, phase, amplitude, modulation, etc.) that enable embedding data, such as binary computer data, within the capture signal 402. In the example embodiment, the mobile device 302 performs one or more modulation schemes or methods to embed data with the capture signal 402. That is, the mobile device 302 performs frequency-based modulation, amplitude-based modulation, phase-based modulation, or combinations thereof to embed the data such that a corresponding device-receiving the signal (e.g., the gaming machine 310) can extract the data using acoustic signal analysis techniques. Examples of modulation schemes include continuous wave modulation schemes, analog modulation schemes, and digital modulation schemes, such as frequency-shift keying (FSK), phase-shift keying (PSK), and amplitude-shift keying (ASK). In some embodiments, the mobile device 302 does not generate the capture signal 402, but rather, for example, receives the modulated capture signal 402 from the gaming machine 310 or the game network 360.

In the example embodiment, the capture signal 402 is representative of a player account identifier 404. The player account identifier 404 is associated with a player account 406 of the player 301 and may be stored by the game network 360. The player account 406 includes information associated with the player 301, such as, and without limitation, historical game play data, order data (e.g., food and drinks ordered by the player 301), credit balance data, player data, and the like. In at least some embodiments, the player account identifier 404 is embedded in the capture signal 402. In other embodiments, representative data associated with the player account identifier 404 is embedded in the capture signal 402 in place of the player account identifier 404. For example, the representative data may be an encryption key associated with the player account identifier 404 and/or an encrypted player account identifier 404. In another example, the data may be a portion of the player account identifier 404. Additionally, the capture signal 402 may include supplemental data 408 with the player account identifier 404 or the representative data. The supplemental data 408 may be used to authenticate the capture signal 402, provide details regarding an available communication channel provided by the mobile, and/or other suitable information. In one example, the supplemental data 408 includes a timestamp to prevent fraudulent parties from recording a previous capture signal 402 for fraudulent use. In another example, the supplemental data 408 may provide information to facilitate establishing Bluetooth or Wi-Fi communications with the mobile device 302. In yet another example, the supplemental data 408 includes a pre-shared encryption key, a pairing key for communications, a server internet protocol (IP) address, a universal resource locator (URL) associated with the system 300 or the mobile device 302, and/or the like. In other embodiments, the capture signal 402 is not embedded with the player account identifier 404 or the representative data. Rather, in such embodiments, a different identifier is used to retrieve the correct player account 406 and/or to establish communications between the mobile device 302 and the gaming system 300.

When the capture signal 402 is generated, the application installed on the mobile device 302 causes the acoustic output component of the mobile device 302 to emit the capture signal 402. In at least some embodiments, the capture signal 402 is emitted inaudibly. That is, human acoustic systems are unable to detect the frequencies and the amplitude of the capture signal 402. The frequency range of audible tones is approximately between 20 Hertz (Hz) and 20 kHz. Inaudible tones have frequencies outside of this range. In one example, the capture signal 402 is an ultrasonic acoustic signal (i.e., greater than 20 kHz). In other embodiments, at least a portion of the capture signal 402 may be an audible tone. To avoid cross-communication with other mobile devices 302 and/or gaming machines 310 and noise degradation, the capture signal 402 may have a limited communication range (e.g., approximately 5-40 centimeters). For example, the amplitude (i.e., the loudness) of the capture signal 402 may be relatively low to reduce the effective communication range of the capture signal 402.

In the example embodiment, when the capture signal 402 is emitted, the application causes the mobile device 302 to display instructions to the player 301 regarding where to position the mobile device 302 relative to the gaming machine 310 to accommodate the limited communication range of the capture signal 402. The gaming machine 310 may also include instructions, graphics, and the like that indicate where the mobile device 302 should be positioned. When the player 301 approaches the gaming machine 310, the presence sensor 330 detects the player 301 and/or the mobile device 302. In some embodiments, the presence sensor 330 automatically detects the player 301 and/or the mobile device 302 (e.g., the presence sensor 330 detects the proximity of objects within its detection range). In other embodiments, the player 301 or the mobile device 302 may initiate contact with the presence sensor 330 (e.g., the mobile device communicatively couples to the sensor 330 via BLE).

In response to the detection, the logic circuitry 340 is configured to activate the acoustic input component 322 to receive 502 the capture signal 402 from the mobile device 302. Prior to activation, the acoustic input component 322 is inactive to limit cross-communication and errors caused by noise. When the acoustic input component 322 receives 502 the capture signal 402, the signal 402 is converted from an analog acoustic signal to a digital signal for analysis by the logic circuitry 340. The logic circuitry 340 is configured to perform acoustic signal analysis on the capture signal 402 to determine 504 the player account identifier 404. For example, if the player account identifier 404 is embedded in the capture signal 402, the logic circuitry 340 is configured to extract the player account identifier 404. In some embodiments, the gaming machine 310 transmits the capture signal 402 to the game network 360 for analysis. In such embodiments, the game network 360 is configured to determine the player account identifier 404 from the capture signal 402.

In the example embodiment, the gaming machine 310 retrieves 506 account data 410 associated with the player account 406 from the game network 360. In particular, the gaming machine 310 queries the game network 360 using the player account identifier 404. The game network 360 performs a lookup of stored player accounts using the player account identifier 404 and retrieves the account data 410. The account data 410 may include, for example, historical game play data, order data, and/or other information from the player account 406. In some embodiments, a credit balance associated with the player 301 may be established based on the account data 410. That is, credits may be transferred from the player account 406 to the gaming machine 310 for the gaming session. In such embodiments, when the gaming session is ended, the remaining credit balance at the gaming machine 310 may be transferred back to the player account 406 for subsequent play.

When the account data 410 is retrieved 506, the gaming machine 310 establishes 508 a gaming session associated with the player account 406. In the example embodiment, during or after the gaming session, the logic circuitry 340 transmits 510 game play information 412 related to the gaming session to the player account 406 on the game network 360. The game play information 412 includes information associated with the current gaming session, such as, and without limitation, game play results, winning outcomes, current credit balance, wagers placed, and the like. The gaming play information 412 is collected and/or generated by the logic circuitry 340 during the gaming session. The game play information 412 may be transmitted 510 periodically (e.g., at the end of each play of the game) or asynchronously. For example, the game play information 412 may be transmitted 510 at the conclusion of the gaming session. The player account 406 is updated with the game play information 412 such that account data 410 retrieved for subsequent gaming sessions may incorporate at least a portion of the game play information 412.

In certain embodiments, the mobile device 302 and the game network 360 communicate with each other during the session-establishment process 500. In one example, to initiate the process 500, the mobile device 302 transmits an activation signal 414 to the game network 360. The activation signal 414 is a digital signal indicating that the mobile device 302 is emitting the capture signal 402. In some embodiments, the activation signal 414 includes the player account identifier 404 and/or location data associated with the mobile device 302. The player account identifier 404 may be used to authenticate the player 301. That is, the player account identifier 404 from the capture signal 402 is compared to the player account identifier included with the activation signal 414 to verify that the authentic player 301 is establishing the gaming session. If the activation signal 414 includes location data (e.g., Global Positioning System (GPS) data), the game network 360 may notify gaming machines 310 proximate to the player 301 to activate their corresponding acoustic input components 322. In other embodiments, the activation signal 414 is an audio signal emitted by the mobile device 302 or the gaming machine 310. In such embodiments, the activation signal 414 may be embedded with preliminary data to identify the mobile device 302 or the gaming machine 310. In response to receiving the activation signal, the mobile device 302 or the gaming machine 310 may activate their corresponding audio interface to initiate the session-establishment process 500.

During the gaming session, the mobile device 302 may receive at least a portion of the account data 410 and/or the game play information 412 from at least one of the gaming machine 310 or the game network 360. For example, the mobile device 302 may display secondary content (e.g. player tracking information, supplemental game content, etc.) for the gaming session to player 301 based at least partially upon the account data 410 and/or the game play information 412. In some embodiments, the mobile device 302 transmits app data 416 to the gaming machine 310 and/or the game network 360 during the gaming session. The app data 416 includes user input, payment information, device information, and other information stored or collected by the mobile device for the gaming session. For example, the app data 416 may include user input for placing a wager for the wagering game or payment information from a digital wallet stored on the mobile device 302 to complete transactions, such as transaction to purchase additional credits, drinks, food, and the like. The app data 416 may be transmitted periodically or asynchronously to the gaming machine 310 and/or the game network 360.

In at least some embodiments, the acoustic interface 320 (shown in FIG. 3) includes a device interface on the cabinet of the gaming machine 310 to facilitate communication between the mobile device 302 and the gaming machine 310 during the session-establishment process 500. In particular, due to the limited communication range of the capture signal 402, the device interface is positioned near the acoustic input component 322 such that the device interface is within the communication range of the capture signal 402. In certain embodiments, the device interface is configured to receive the mobile device and direct acoustic signals from the mobile device 302 to the acoustic input component 322. Similarly, if the capture signal 402 is transmitted by the acoustic output component 324 to the mobile device, the device interface directs the capture signal 402 towards the mobile device 302.

Figure 6:
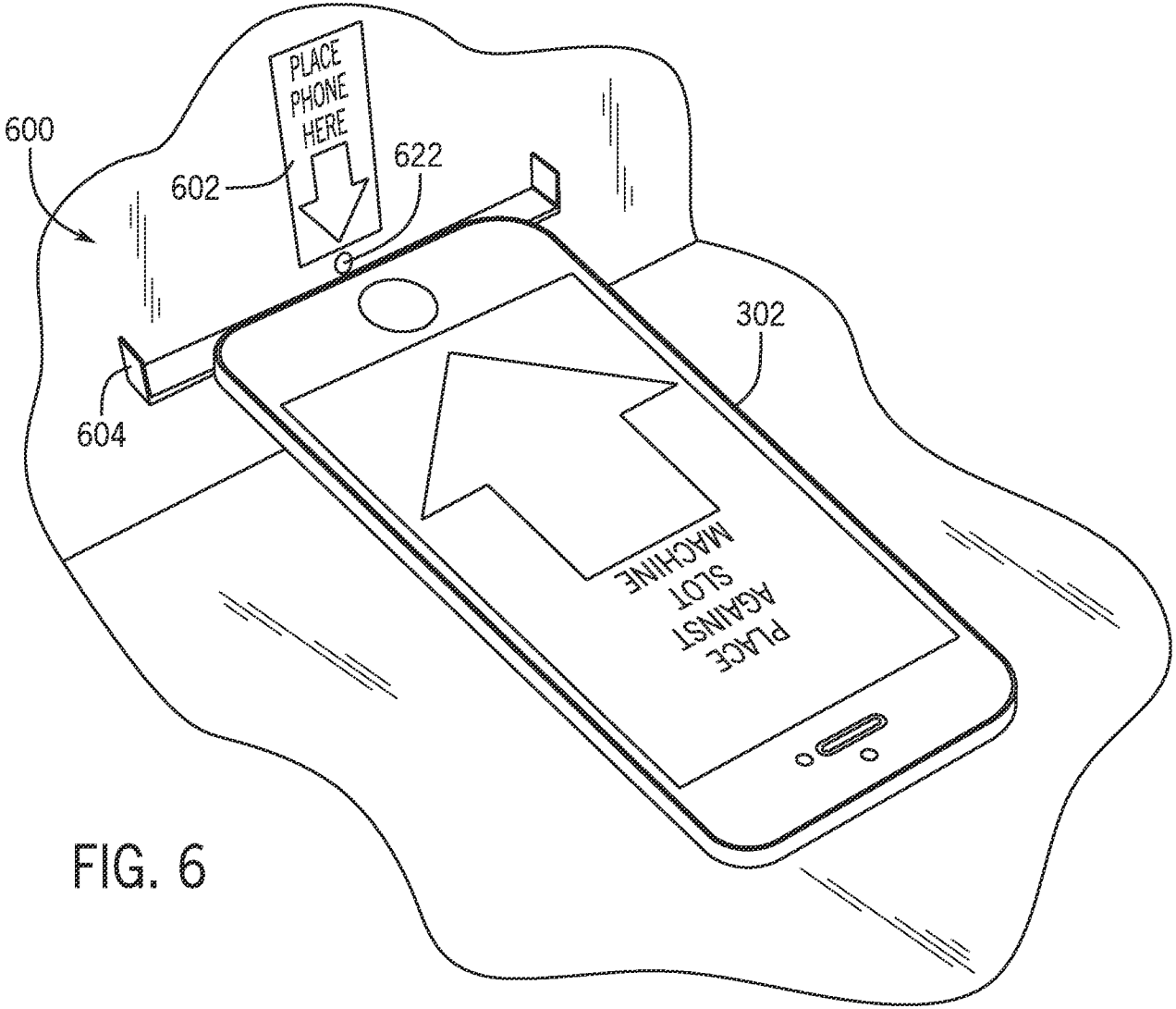
FIG. 6 is a perspective view of device interface according to an embodiment of the invention.

FIG. 6 is a perspective view of an example device interface 600 for use with the gaming system 300 (shown in FIG. 3). In the example embodiment, interface 600 is positioned near an acoustic input component 622 and one or more value input and/or output devices. Interface 600 includes an instruction graphic 602 and a device-receiving component 604. In other embodiments, interface 600 includes additional, fewer, or alternative components, including those described elsewhere herein. For example, interface 600 may not include the instruction graphic 602.

The instruction graphic 602 is positioned near the receiving component 604 to visually prompt the player 301 (shown in FIG. 3) where to place his or her mobile device 302. The graphic 602 may be, for example, a sticker, a painted image, a placard, a graphical display, and/or other visual indicators. The graphic 602 may include a set of instructions, an image of a mobile device, and/or other visual instructions. In certain embodiments, the graphic 602 is paired with instructions displayed on the mobile device 302 to prompt the player 301 to position the mobile device 302 properly in the interface 600. In the example embodiment, the mobile device 302 may be horizontally oriented (as shown in FIG. 6) or vertically oriented relative to the interface 600 to facilitate the functions described herein.

Figure 7:
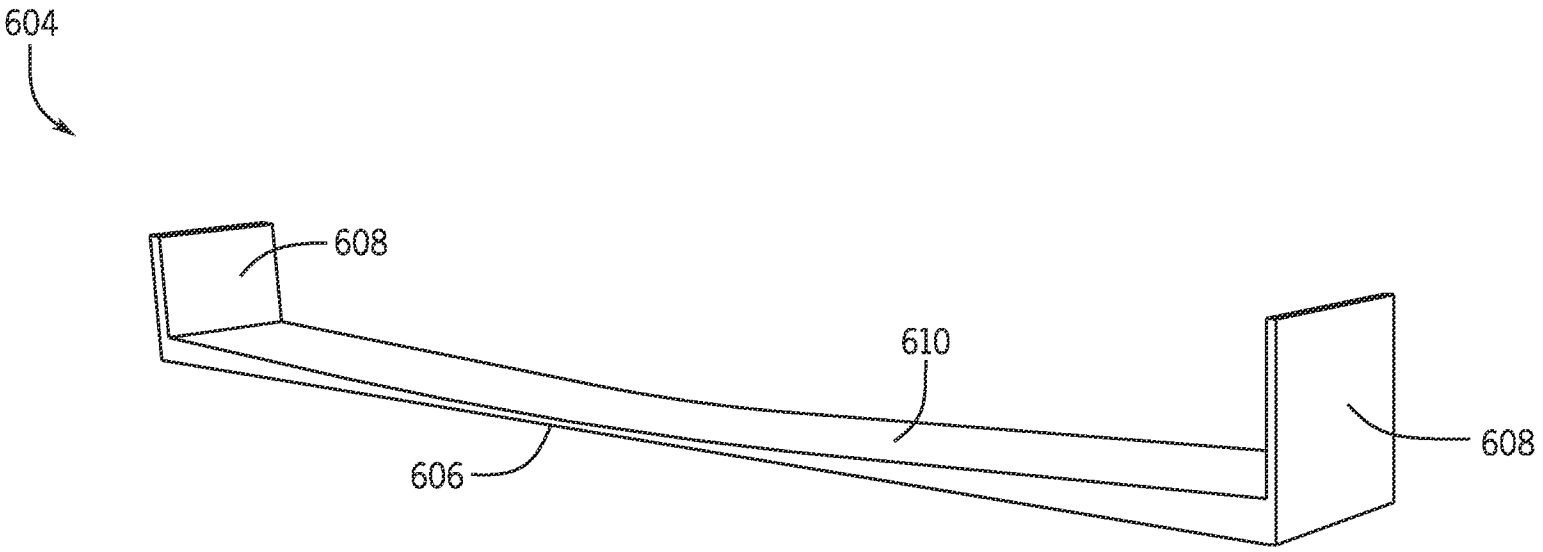
FIG. 7 is a perspective view of a receiving component of the device interface shown in FIG. 6 for receiving mobile user devices.

The device-receiving component 604 is configured to receive the mobile device 302 and direct acoustic signals between the mobile device 302 and the acoustic input component 622. FIG. 7 is a perspective view of the device-receiving component 604. With respect to FIGS. 6 and 7, the receiving component 604 includes a base member 606 that extends between two side members 608. In the example embodiment, the side members 608 extend substantially perpendicular to the base member 606. The base member 606 includes a receiving surface 610 for receiving the mobile device 302. The receiving surface 610 is configured to receive the mobile device 302 vertically or horizontally. In the example embodiment, the base member 606 is not flat. That is, the base member 606 is curved to form a concave receiving surface 610. Mobile devices typically have substantially flat edges, and thus a gap may be formed between a portion of the mobile device 302 and the receiving surface 610. The gap is configured to direct acoustic sound waves between the acoustic interfaces of the mobile device 302 and the acoustic input component 622. In other embodiments, the base member 606 is curved to form a convex receiving surface 610. Alternatively, the base member 606 may be substantially flat relative to the side members 608.

In the example embodiment, the receiving component 606 does not include supports for securing the mobile device 302 to the interface 600 because the relatively short amount of time required to transmit the capture signal 402 does not require the mobile device 302 to be positioned on the interface 600 for extended periods of time. After the capture signal 402 is transmitted and received, the mobile device 302 does not need to stay within the communication range defined by the capture signal 402, thereby enabling the player 301 to use and move the mobile device 302 without further consideration of the interface 600. In other embodiments, the receiving component 606 includes one or more supporting members (not shown) to secure the mobile device 302. In such embodiments, the mobile device 302 and the gaming machine 310 may continue to communicate with each other using acoustic signals. For example, acoustic signals may be transmitted by the mobile device 302 to the gaming machine 310 to maintain the gaming session as described herein.

Figure 8:
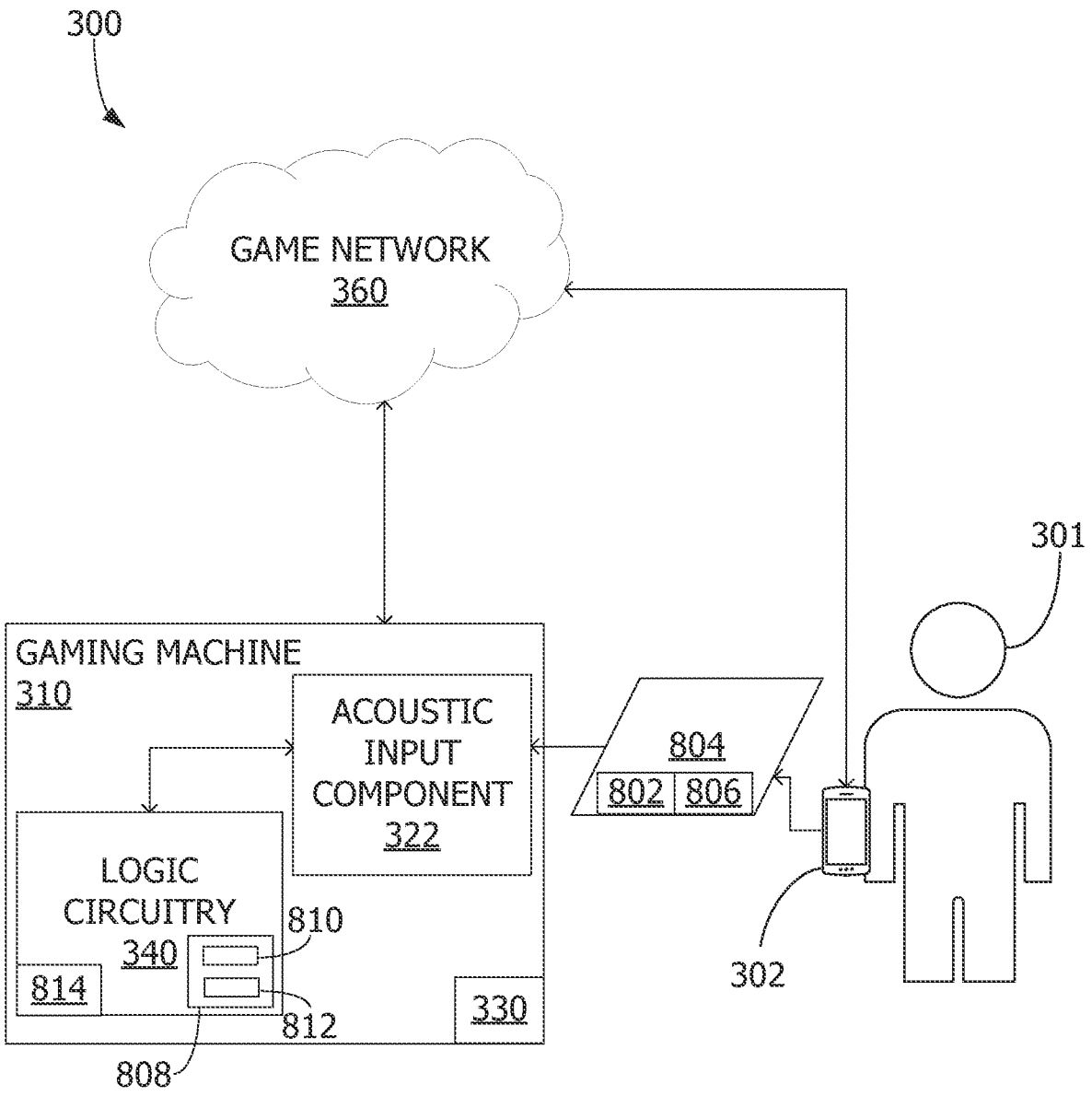
FIG. 8 is a data flow diagram of a maintain-session process performed by the example gaming system shown in FIG. 3.
Figure 9:
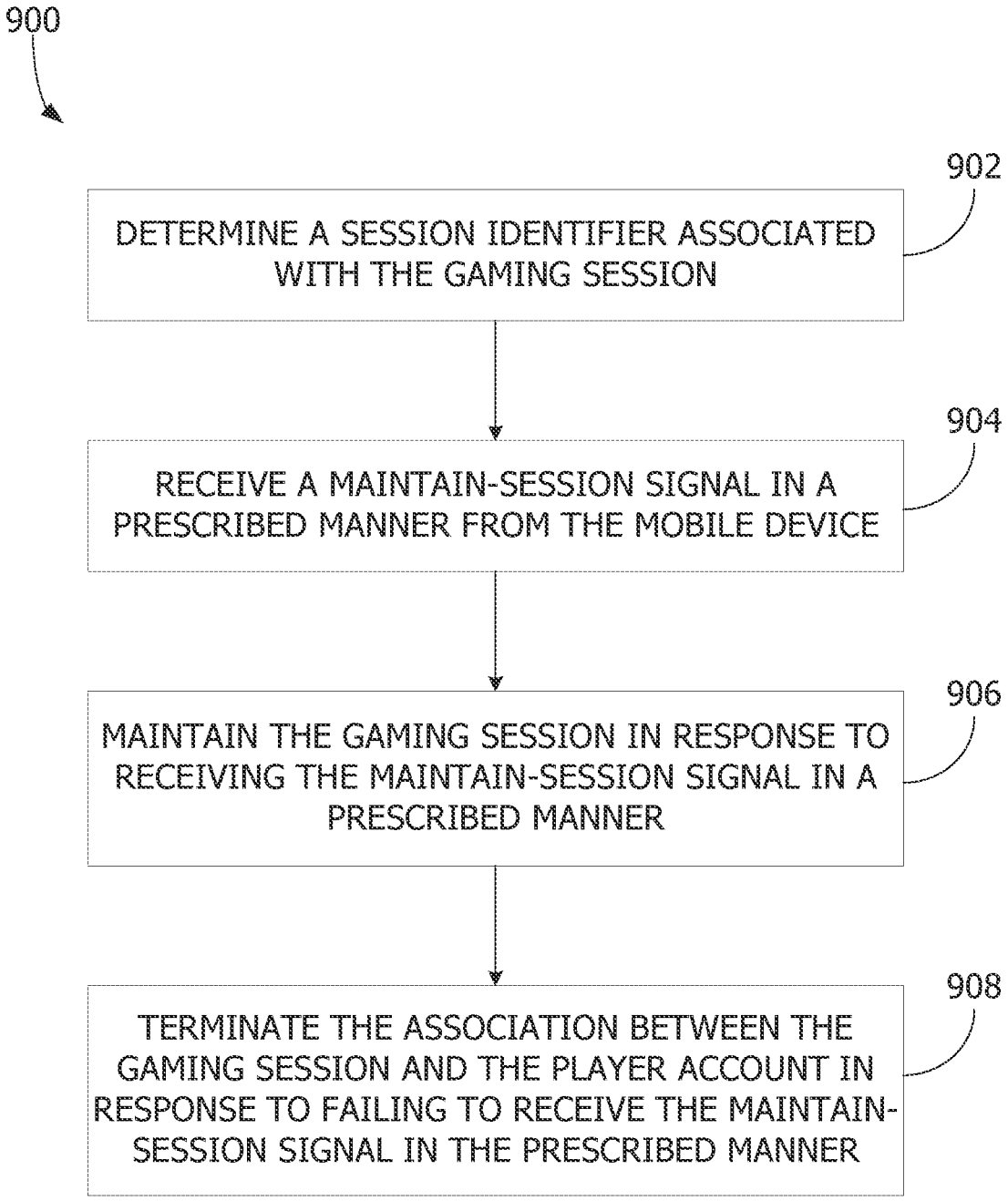
FIG. 9 is a flowchart of an example maintain-session process in accord with at least some aspects of the disclosed concepts.

FIG. 8 is a data flow diagram of an example maintain-session process performed by the gaming system 300 shown in FIG. 3. FIG. 9 is a flow diagram of the maintain-session process 900 shown in FIG. 8. In other embodiments, the process 900 may include additional, fewer, or alternative data elements and/or steps, including those described elsewhere herein.

When a gaming session is established at the gaming machine 310, the logic circuitry 340 or the mobile device 302 determines 902 a session identifier 802 associated with the gaming session. In the example embodiment, the session identifier 802 is a unique identifier received by the gaming machine 310 and the mobile device 302 from the game network 360 to verify the identity and presence of the mobile device 302 during the gaming session. For example, the session identifier 802 may be a player account identifier (e.g., player account identifier 404, shown in FIG. 4), a device identification number (e.g., of the mobile device 302 or the gaming machine 310), a phone number, a randomly-generated alphanumeric identifier, and the like. In certain embodiments, the session identifier 802 is an acoustic signature associated with the mobile device 302 and/or the gaming machine 310. That is, in such embodiments, the session identifier 802 is an acoustic signal with a set of characteristics that identify the mobile device 302 and/or the gaming machine 310. In one example, the session identifier 802 is an unmodulated audio tone, such as an audio pulse, that is associated with the gaming session. In some embodiments, the session identifier 802 may be generated by the mobile device 302 or the gaming machine 310 and transmitted to the other device for storage and subsequent use. The session identifier 802 may be static or dynamic. For example, the identifier 802 may be updated periodically, at the beginning of a gaming session, and/or at the end of the gaming session.

The session identifier 802 is stored by the logic circuitry 340 and linked to the gaming session of the player 301. The session identifier 802 is also stored by the mobile device 302 for the maintain-session process 900. In some embodiments, the session identifier 802 may be generated and/or assigned by the game network 360 to the mobile device 302 and the gaming machine 310. In one example, the logic circuitry 340 transmits the session identifier 802 to the game network 360 for subsequent transmittal to the mobile device 302. In another example, the game network 360 retrieves the session identifier 802 from the player account 406 (shown in FIG. 4) associated with the player 301.

In the example embodiment, to maintain the gaming session of the player 301, the mobile device 302 is configured to generate and emit a maintain-session signal 804. The maintain-session signal 804 is an acoustic signal having unique maintain-session characteristics that represent the session identifier 802. That is, the maintain-session characteristics of the signal 804 form a bit stream including embedded data representing the session identifier 802. The embedded data, similar to the embedded data within the capture signal 402 (shown in FIG. 4), may include, but is not limited to, at least a portion of the session identifier 802, encrypted data representing the identifier 802, an encryption key associated with the identifier 802, and/or another abstraction of the session identifier 802. In addition, in some embodiments, the embedded data includes supplemental data 806 to provide various features. For example, the supplemental data 806 may include a timestamp or time code to verify the maintain-session signal 804 as authentic rather than a prerecorded maintain-session signal. The embedded data may be encrypted to limit fraudulent parties from intercepting the maintain-session signal 804. In certain embodiments, the maintain-session signal 804 does not include data, but rather includes audio characteristics that, when analyzed, verify the presence of the mobile device 302. For example, the maintain-session signal 804 may be an unmodulated signal with an audio tone representing the session identifier 802. In other embodiments, the maintain-session signal 804 is received by the mobile device 302 from the gaming machine 310 and/or the game network 360. In one embodiment, the gaming machine 310 generates and emits the maintain-session signal 804 (e.g., via the acoustic output component 324, shown in FIG. 3) to the mobile device 302. The mobile device 302 then stores the signal 804 for subsequent use.

The maintain-session signal 804 may include audible and/or inaudible (e.g., ultrasonic) tones similar to the capture signal 402. In one embodiment, the maintain-session signal 804 has a frequency range approximately at 18 kHz. In the example embodiment, the maintain-session signal 804 has acoustic characteristics that cause the signal 804 to be substantially imperceptible to the human auditory system when emitted by the mobile device. In other embodiments, the signal 804 is perceptible to the human auditory system. In certain embodiments, the maintain-session signal 804 may have variable acoustic characteristics, thereby enabling the mobile device 302 to vary the emission of the signal 804. For example, the signal 804 may initially be imperceptible to the human auditory system and gradually become perceptible if there is no confirmation that the signal 804 was received. In one example, to calibrate the maintain-session signal 804, the maintain-session signal 804 may be emitted at varying amplitudes, frequencies, and/or phases to determine a communication range, the quality of communication, and other factors that may be adjusted in response to calibration.

Similar to the capture signal 402, the maintain-session signal 804 has a limited communication range to prevent cross-communication and noise degradation. In the example embodiment, the communication range of the maintain-session signal 804 is greater than the communication range of the capture signal 402 to enable the player 301 to move and use the mobile device 302 throughout the gaming session. For example, the communication range of the maintain-session signal 804 may be between 50 cm and 500 cm while the communication range of the capture signal 402 is between 10 cm and 30 cm.

The logic circuitry 340 receives 904 the maintain-session signal 804 emitted by the mobile device 302 in a prescribed manner via the acoustic input component 322. The logic circuitry 340 then extracts the embedded data from the signal 804 using acoustic signal analysis and determines 806 the session identifier 802 from the extracted data. In certain embodiments, if the session identifier 802 is not previously known by the logic circuitry 340, the logic circuitry 340 links the session identifier 802 to the gaming session and stores the identifier 802 for comparison to the session identifiers of subsequent maintain-session signals. If the session identifier 802 has been previously stored by the gaming machine 310 (or the game network 360), the determined session identifier 802 is compared to the previously stored session identifier 802. If the two session identifiers substantially match, the logic circuitry 340 assumes the player 301 is still present at the gaming machine 310 and maintains 906 the gaming session (and the association between the gaming session and the player account 406 (shown in FIG. 4) of the player 301). If the comparison does not result in a substantial match, the comparison may indicate that the player 301 has left the gaming machine 310.

When the logic circuitry 340 fails to receive the maintain-session signal 804 according to the prescribed manner, the logic circuitry 340 terminates 908 the association between the gaming session and the player account 406. In some embodiments, terminating 908 the association also automatically terminates the gaming session. In other embodiments, the gaming session continues without being associated to the player account 406. In some embodiments, the logic circuitry 340 may terminate the association between the player account 406 and the gaming session if the logic circuitry 340 receives, via the acoustic input component 322, a maintain-session signal that includes a session identifier associated with a mobile device other than the mobile device 302 of the player 301. The signal with the new session identifier may indicate that the player 301 has left the gaming machine 310 and a new player is present at the gaming machine. In such embodiments, the logic circuitry 340 may automatically terminate the gaming session of the player 301 and initiate a session-establishment process (e.g., the process 500, shown in FIG. 5) for the new player. In certain embodiments, the logic circuitry 340 may communicate the session identifier associated with the new player to the game network 360 and/or other gaming machines. If the new player is associated with a current gaming session at another gaming machine, the other gaming machine may automatically end the gaming session of the new player.

In the example embodiment, the prescribed manner defined by the process 800 includes receiving 904 the maintain-session signal 804 periodically to continue to maintain 906 the gaming session. In particular, the logic circuitry 340 stores a time schedule 808 that defines the frequency at which the maintain-session signal 804 is expected from the mobile device 302. The frequency may be, for example, and without limitation, every 10 seconds, 30 seconds, 1 minute, or 3 minutes. The frequency may be variable based on one or more timing criteria. The timing criteria may indicate activity by the player 301 and/or the mobile device 302 beyond the maintain-session signal 804, such as the last received user input at the gaming machine 310, activity on a communication channel between the gaming machine 310 and the mobile, detection of the player 301 using the presence sensor 330 (shown in FIG. 3).

The time schedule 808 includes a presence counter 810 associated with the gaming session. The presence counter 810 is initiated in response to one or more trigger events. The trigger events may include, but are not limited to, receiving a maintain-session signal 804, failing to receive the signal 804 at a predetermined time according to the time schedule 808, failing to detect the player 301 with the presence sensor 330, or terminating a communication channel between the mobile device 302 and the gaming machine 310. The presence counter 810 is incremented or decremented over time and compared to a predetermined presence threshold value 812. The initial value of the presence counter 810 or the threshold value 812 may be variable to vary based on the timing criteria. The logic circuitry 340 determines whether or not the player 301 is still present based on the comparison. In one example, the presence threshold value 812 is zero, and the presence counter 810 is decremented over time. When the presence counter 810 reaches zero, an end-session process is initiated to terminate the gaming session. In certain embodiments, the logic circuitry 340 may notify the player 301 that when the counter 910 is approaching the threshold value 812 and no maintain-session signal 804 has been received. The logic circuitry 340 resets the presence counter 810 each time the maintain-session signal 804 is received 904 from the mobile device 302. In some embodiments, when the presence counter 810 is reset, the logic circuitry 340 determines whether or not to modify the initial value of the presence counter 810 or the threshold value 812 based on the timing criteria.

In certain embodiments, the logic circuitry 340 is configured to determine a distance between the gaming machine 310 and the player 301 and/or the mobile device 302. If the distance exceeds a predetermined maximum distance 814 stored in memory by the logic circuitry 340, the logic circuitry 340 may determine that the player 301 has abandoned the gaming session. In response, the logic circuitry 340 terminates the association between the gaming session and the player account 406 and/or terminates the gaming session altogether. In at least some embodiments, the presence sensor 330 is configured to determine the distance between the player 301 (or the mobile device 302) and the gaming machine 310. In one example, the presence sensor 330 may not determine the specific distance, but rather defines the predetermined maximum distance 814 by its detection range such that players and mobile devices detected within the detection range are not outside of the predetermined maximum di stance 814.

Figure 10:
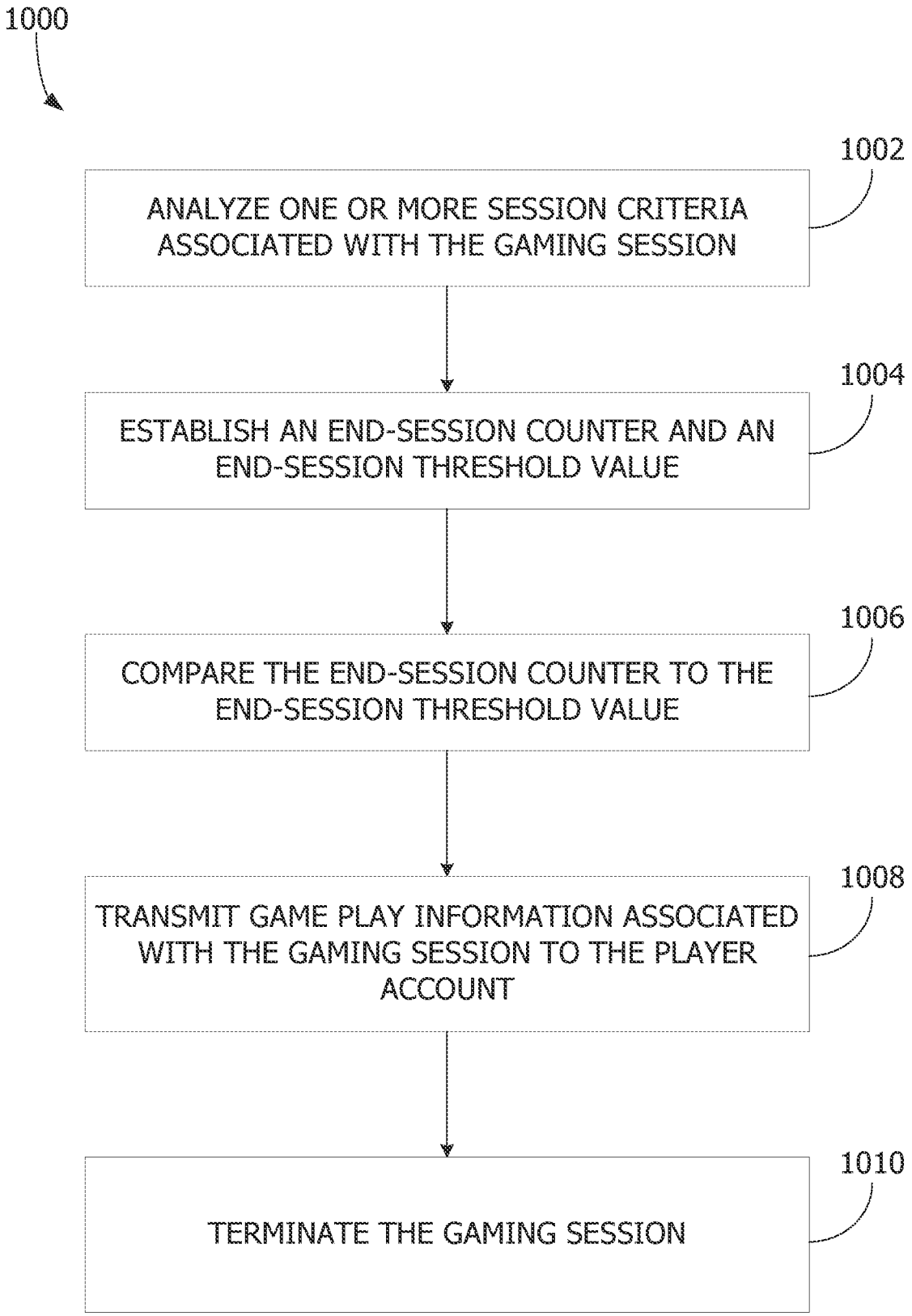
FIG. 10 is a flowchart of an example end-session process in accord with at least some aspects of the disclosed concepts.

FIG. 10 is a flowchart diagram of an example end session process 1000 performed by the gaming system 300 (shown in FIG. 3). In particular, the process 1000 is performed at least partially by the logic circuitry 340 (shown in FIG. 3). That is, the logic circuitry 340 stores one or more instructions that, when executed, cause the logic circuitry 340 to perform one or more steps of the process 1000. In some embodiments, the process 1000 may be at least partially performed by a different device or system, such as the game network 360 (shown in FIG. 3). In other embodiments, the process 1000 includes additional, fewer, or alternative steps, including those described elsewhere herein.

With respect to FIGS. 3 and 10, when the player is determined to be inactive or absent from the gaming machine 310 for a period of time (e.g., failure to receive the maintain-session signal 804, shown in FIG. 8), the logic circuitry 340 analyzes 1002 one or more end-session criteria associated with the gaming session. The end-session criteria is information that may be indicative of the likelihood that the player 301 will continue the gaming session (i.e., the player 301 interrupts the process 1000). For example, if the player 301 has a credit balance with remaining credits, the player 301 is more likely to continue the gaming session than if the player 301 has no remaining credits. In another example, the logic circuitry 340 determines whether or not the mobile device 302 and the gaming machine 310 are communicatively coupled to each other via one or more communication channels, such as BLE, Bluetooth, NFC, Wi-Fi, etc. That is, if the mobile device 302 and the gaming machine 310 are communicatively coupled to each other, the mobile device 302 and the player 301 are located within a distance of the gaming machine 310 defined by the communication channel, and thus may be returning to the gaming machine 310.

In at least some embodiments, the analysis of the end-session criteria may result in the player 301 and/or the logic circuitry 340 terminating the process 1000 to continue the gaming session. More specifically, the gaming machine 310 or the mobile device 302 may display a notification to the player 301 indicating the gaming session is ending. The player 301 may provide user input to indicate whether or not the player 301 wants to continue the gaming session. Additionally or alternatively, the logic circuitry 340 automatically continues the gaming session based on the analysis of the end-session criteria. In one example, the end-session criteria indicates that the presence sensors 330 detects the player 301 and the mobile device 302 is in communication with the gaming machine 310 via BLE. If the process 1000 was preceded by a maintain-session process using acoustic signals (e.g., the process 900, shown in FIG. 9), the end-session criteria in this example may indicate that acoustic communication between the mobile device 302 and acoustic interface 320 is blocked, which may be caused by the mobile device 302 being placed in a pocket, purse, or bag of the player 301 during the gaming session. In this example, the mobile device 302 or the gaming machine 310 provides a visible, audible, and/or tactile (e.g., vibration) notification to the player 301 to prompt the player 301 position the mobile device 302 in a suitable location for the maintain-session process.

In the example embodiment, based on the analysis of the end-session criteria, the logic circuitry 340 establishes 1004 an end-session counter and an end-session threshold value. The end-session counter and/or the end-session threshold value are variable based on the analysis of the end-session criteria to provide more time to players more likely to continue the gaming session and less time to players less likely to continue the gaming session. Extending the time provided to players more likely to continue the gaming session facilitates reducing the amount of prematurely ended gaming sessions that may discourage the players from subsequent play. Decreasing the time provided to players less likely to continue the gaming session facilitates increased availability of the gaming machine 310 to new players, thereby decreasing down time between gaming sessions.

The end-session counter is incremented or decremented over time and is periodically compared 1006 to the end-session threshold by the logic circuitry 340. When an end-session event (e.g., the value of the end-session counter is equal to the end-session threshold value) is detected based on the comparison, the logic circuitry 340 transmits 1008 the game play information 412 associated with the gaming session to the player account 406 (shown in FIG. 4) of the player 301. For example, if there are remaining credits, the credits are applied to the player account 406 or are otherwise refunded to the player 301. In another example, game play progress during the gaming session is stored with the player account 406 to enable subsequent play without loss the progress. In some embodiments, the association between the player account 406 and the gaming session is terminated prior to the process 1000, such as by the maintain session process 900 shown in FIG. 9. In such embodiments, the transmitting 1008 step may not be performed, although remaining credits may still be refunded to the player 301. Afterwards, the logic circuitry 340 terminates 1010 the gaming session associated with the player 301 to enable other players to establish new gaming sessions at the gaming machine 310.

With reference to FIGS. 3, 5, 9, and 10, the session-establishment process 500, the maintain-session process 900, and the end-session process 1000 may be performed by system 300 separately or in combination with each other. For example, in some embodiments, the system 300 may only perform the session-establishment process 500 while using other processes and techniques for maintaining and ending the gaming session. In at least some embodiments, when the session-establishment process 500 and the maintain-session process 900 are performed by the gaming system 300, the logic circuitry 340 is configured to distinguish between capture signals and maintain-session signals to prevent cross-communication with other mobile devices and gaming machines. In particular, the capture signals and the maintain-session signals have distinctive acoustic characteristics that enable the logic circuitry 340 to distinguish between the two signal types using signal analysis and/or acoustic filters. For example, the capture signals and the maintain-session signals may use different frequency bands (frequency ranges) to transmit the embedded data. In one example, the capture signals are emitted at frequencies and amplitudes that facilitate higher data bandwidth over shorter ranges relative to the frequencies and amplitudes of the maintain-session signals which may have a relatively low data bandwidth and a relatively larger communication range. In some embodiments, the capture signals and the maintain-session signals use different modulation schemes to transmit the embedded data. In one example, the capture signals use phase-based modulation while the maintain-session signals use frequency-based modulation. In this example, the logic circuitry 340 decodes or demodulates a received acoustic signal based on the expected type of signal depending on which process is being performed. In certain embodiments, the capture signals and/or the maintain-session signals include embedded data that identify the type of acoustic signal (e.g., supplemental data 408 and 806, shown in FIGS. 4 and 8, respectively).

In some embodiments, the directionality of the acoustic communication between the mobile device 302 and the gaming machine 310 may be different for the session-establishment process 500 and the maintain-session process 900. In one example, the session-establishment process 500 involves the capture signal 402 (shown in FIG. 4) being received by the acoustic input component 322 from the mobile device while the maintain-session process 900 involves the acoustic output component 324 emitting the maintain-session signal 804 (shown in FIG. 8) to be received by the mobile device. In another example, the session-establishment process 500 involves unidirectional communication via acoustic signals while the maintain-session process 900 involves bidirectional communication, thereby facilitating data transmission back and forth between the mobile device 302 and the gaming machine 310 during the gaming session.

The foregoing gaming systems and methods facilitate establishing, maintaining, and terminating a gaming session associated with a player account on a gaming machine using acoustic signatures communicated between the gaming machine and a mobile device of the player. Moreover, the foregoing gaming systems and methods facilitate linking or pairing the mobile device to the gaming session to provide additional features to the player via the mobile device. The use of acoustics rather than other forms of communication (BLE, NEC, etc.) facilitates increased device compatibility. Due to the relatively small amount of data transmitted by the acoustic signals, the relatively low processing used to decode the acoustic signals, and the selective allocation of computing resources to receiving and/or emitting the acoustic signals, the foregoing systems and methods facilitate improved computing and networking resource availability at the gaming machines for other tasks. In addition, at least some content may be transferred to the mobile device of the player, thereby further improving computing and networking resource availability at the gaming machines.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system comprising:

a gaming machine configured to conduct a casino wagering game, the gaming machine including an acoustic input component and an acoustic output component; and logic circuitry configured to:

receive, via the acoustic input component, an acoustic capture signal from a mobile device, the acoustic capture signal representative of a player account identifier corresponding to a player account, the acoustic capture signal having distinctive capture characteristics;

determine the player account identifier represented by the acoustic capture signal and associate a gaming session of the casino wagering game on the gaming machine with the corresponding player account;

generate an acoustic maintain-session signal associated with the gaming session, the acoustic maintain-session signal having distinctive maintain-session characteristics;

emit the acoustic maintain-session signal via the acoustic output component;

in response to the mobile device indicating the acoustic maintain-session signal was received by the mobile device in a prescribed manner, maintain the association between the gaming session and the player account for a period of time; and in response to the mobile device indicating that the mobile device failed to receive the acoustic maintain-session signal in a prescribed manner, terminate the association between the gaming session and the player account.

2. The gaming system of claim 1, wherein the gaming machine includes a presence sensor, and wherein the logic circuitry is further configured to:

detect, via the presence sensor, an indication of the mobile device being within a detection range; and in response to detecting the indication, trigger the gaming machine to receive the acoustic capture signal.

3. The gaming system of claim 1, wherein at least one of the acoustic capture signal or the acoustic maintain-session signal is an audible tone.

4. The gaming system of claim 1, wherein the acoustic capture signal has a first modulation scheme, and the acoustic maintain-session signal has a second modulation scheme different from the first modulation scheme.

5. The gaming system of claim 1, wherein the logic circuitry comprises game logic circuitry, the gaming machine including the game logic circuitry.

6. A method of operating a gaming system, the gaming system including logic circuitry and a gaming machine with an acoustic input component and an acoustic output component, the method comprising:

receiving, by the logic circuitry via the acoustic input component, an acoustic capture signal from a mobile device, the acoustic capture signal representative of a player account identifier corresponding to a player account, the acoustic capture signal having distinctive capture characteristics;

determining, via the logic circuitry, the player account identifier represented by the acoustic capture signal and associating, via the logic circuitry, a gaming session on the gaming machine with the corresponding player account;

generating, via the logic circuitry, an acoustic maintain-session signal associated with the gaming session, the acoustic maintain-session signal having distinctive maintain-session characteristics;

emitting, via the acoustic output component, the acoustic maintain-session signal for a mobile device associated with the player account;

in response to the mobile device indicating the acoustic maintain-session signal was received by the mobile device in a prescribed manner, maintaining, by the logic circuitry, the association between the gaming session and the player account for a period of time; and in response to the mobile device indicating that the mobile device failed to receive the acoustic maintain-session signal in a prescribed manner, terminating, by the logic circuitry, the association between the gaming session and the player account.

7. The method of claim 6, wherein the acoustic capture signal has a first modulation scheme and the acoustic maintain-session signal has a second modulation scheme different from the first modulation scheme, and wherein at least one of the first modulation scheme or the second modulation scheme is a digital modulation scheme, the digital modulation scheme being one of frequency-shift keying (FSK), phase-shift keying (PSK), or amplitude-shift keying (ASK).

8. The method of claim 7, wherein the player account identifier is embedded in the signal modulation of the acoustic capture signal.

9. The method of claim 6, wherein generating the acoustic maintain-session signal includes embedding a session identifier within the acoustic maintain-session signal, the session identifier associated with the gaming session.

10. The method of claim 9 further comprising receiving, by the logic circuitry in response to emitting the acoustic maintain-session signal, the session identifier from the mobile device to indicate that the acoustic maintain-session signal was received by the mobile device in the prescribed manner.

11. A gaming system comprising:

a gaming machine configured to conduct a casino wagering game, the gaming machine including an acoustic input component and an acoustic output component; and logic circuitry configured to:

cause the acoustic output component to emit an acoustic capture signal to be received by a mobile device of a player, the acoustic capture signal having distinctive capture characteristics associated with the gaming machine;

receive indication that the acoustic capture signal was received by the mobile device;

in response to receiving the indication, identify a player account associated with the player of the mobile device and associate the player account with a gaming session of the casino wagering game;

in response to receiving, in a prescribed manner via the acoustic input component, an acoustic maintain-session signal from the mobile device, the acoustic maintain-session signal having distinctive maintain-session characteristics, maintain the association between the gaming session on the gaming machine and the player account for a period of time; and in response to failing to receive the acoustic maintain-session signal in the prescribed manner, terminate the association between the gaming session on the gaming machine and the player account.

12. The gaming system of claim 11, wherein the gaming machine includes a presence sensor, and wherein the logic circuitry is further configured to:

detect, via the presence sensor, an indication of the mobile device being within a detection range; and in response to detecting the indication, trigger the gaming machine to receive the acoustic capture signal.

13. The gaming system of claim 12, wherein the presence sensor is a proximity sensor.

14. The gaming system of claim 11, wherein the prescribed manner of receiving the acoustic maintain-session signal includes receiving the acoustic maintain-session signal periodically according to a predetermined time schedule.

15. The gaming system of claim 11, wherein the prescribed manner of receiving the acoustic maintain-session signal includes determining a distance between the mobile device and the gaming machine and, in response to the distance exceeding a predetermined maximum distance, storing game play information associated with the gaming session and terminating the gaming session.

16. The gaming system of claim 11, wherein at least one of the acoustic capture signal or the acoustic maintain-session signal is an audible tone.

17. The gaming system of claim 11, wherein the acoustic capture signal has a first modulation scheme and the acoustic maintain-session signal has a second modulation scheme different from the first modulation scheme.

18. The gaming system of claim 11, wherein the logic circuitry includes game logic circuitry, and wherein the gaming machine includes the game logic circuitry.

19. A method of operating a gaming system including logic circuitry and a gaming machine having an acoustic input component and an acoustic output component, the method comprising:

emitting, via the acoustic output component, an acoustic capture signal generated by the logic circuitry to be received by a mobile device of a player, the acoustic capture signal having distinctive capture characteristics associated with the gaming machine;

receiving, by the logic circuitry, indication that the acoustic capture signal was received by the mobile device;

identifying, by the logic circuitry, a player account identifier associated with the player of the mobile device and associating the player account corresponding to the player account identifier with a gaming session of the casino wagering game;

in response to receiving, in a prescribed manner via the acoustic input component, an acoustic maintain-session signal from a mobile device, the acoustic maintain-session signal having distinctive maintain-session characteristics, maintaining, via the logic circuitry, the association between the gaming session on the gaming machine and the player account for a period of time; and in response to failing to receive the acoustic maintain-session signal in the prescribed manner, terminating, via the logic circuitry, the association between the gaming session on the gaming machine and the player account.

20. The method of claim 19, wherein the acoustic capture signal has a first modulation scheme, and the acoustic maintain-session signal has a second modulation scheme different from the first modulation scheme, and wherein at least one of the first modulation scheme or the second modulation scheme is a digital modulation scheme, the digital modulation scheme being one of frequency-shift keying (FSK), phase-shift keying (PSK), or amplitude-shift keying (ASK).

21. The method of claim 20, wherein the player account identifier is embedded in the signal modulation of the acoustic capture signal.

22. The method of claim 19, wherein terminating the association between the gaming session and the player account further comprises:

establishing, via the logic circuitry, a maintain-session counter having an initial value for the gaming session;

causing, via the logic circuitry, the maintain-session counter to increment or decrement periodically, wherein the maintain-session counter is reset to the initial value in response to the acoustic maintain-session signal being received in the prescribed manner; and ending, via the logic circuitry, association between the gaming session and the player account in response to the maintain-session counter matching the threshold value.

23. The method of claim 19 further comprising:

analyzing, via the logic circuitry, the acoustic maintain-session signal to determine a session identifier represented by the acoustic maintain-session signal;

determining, via the logic circuitry, whether the session identifier is associated with the mobile device; and in response to determining the session identifier is associated with the mobile device, maintaining, via the logic circuitry, the association between the gaming session on the gaming machine and the player account for a period of time.

24. The method of claim 19, wherein the prescribed manner of receiving the acoustic maintain-session signal includes receiving the acoustic maintain-session signal periodically according to a predetermined time schedule.

25. The method of claim 24 further comprising:

prior to receiving an expected maintain-session signal according to the predetermined time schedule, activating, by the logic circuitry, the acoustic input component; and in response to receiving the expected maintain-session signal, deactivating, via the logic circuitry, the acoustic input component until activation for a subsequent expected maintain-session signal.

* * * * *